United States Patent [19]

Williams

[11] Patent Number: 4,697,368

[45] Date of Patent: Oct. 6, 1987

[54] AMMUNITION STORAGE COMPARTMENT

[76] Inventor: Edgar L. Williams, 9529 Prairie, Chicago, Ill. 60628

[21] Appl. No.: 928,568

[22] Filed: Nov. 10, 1986

[51] Int. Cl.[4] ..... F41C 23/00; F41C 27/00

[52] U.S. Cl. ..... 42/71.02; 42/59; 42/89

[58] Field of Search ..... 42/89, 71.02, 59, 71.01

[56] References Cited

U.S. PATENT DOCUMENTS

| | | | |
|---|---|---|---|
| 151,882 | 6/1874 | Jones | 42/71.02 |
| 2,509,553 | 5/1950 | Wylie | 42/71.02 |
| 2,805,507 | 9/1957 | Buquor | 42/71.02 |
| 3,722,125 | 3/1973 | Switzer | 42/89 |
| 4,577,429 | 3/1986 | Walser | 42/59 |

*Primary Examiner*—Charles T. Jordan

*Attorney, Agent, or Firm*—Mann, McWilliams, Zummer & Sweeney

[57] ABSTRACT

A housing adapted to be attached to a pistol grip for storage of a fast loading plural cartridge holder for revolvers.

6 Claims, 3 Drawing Figures

AMMUNITION STORAGE COMPARTMENT

BACKGROUND OF THE INVENTION

The present invention is directed to ammunition storage compartments for a pistol. Numerous arrangements of this general type are shown in the prior art patents, U.S. Pat. Nos. 151,882, 746,859, 1,051,960, 1,110,209, 1,485,456, 1,526,847, 2,476,355, 2,509,553 2,805,507 and 4,577,429. None of these arrangements are designed to accommodate the "speed loader" which has been utilized with increasing frequency in recent years. This "speed loader" is more fully described in U.S. Pat. No. 3,722,125 and consists of a fast loading plural cartridge holder for revolvers designed to position each round in a circular orientation for simultaneous release into the chambers of a revolver cylinder.

SUMMARY OF THE INVENTION

The present invention provides an ammunition storage compartment especially designed for housing a fast loading plural cartridge holder for revolvers. One embodiment of the storage compartment includes a housing with a downwardly extending side wall, an open bottom and a flap which can be fastened closed to secure the cartridge holder in place or opened to allow easy removal of the cartridge holder. The storage compartment includes fasteners for securing the compartment to the butt of a pistol grip.

DETAILED DESCRIPTION OF THE INVENTION

Figure 1:
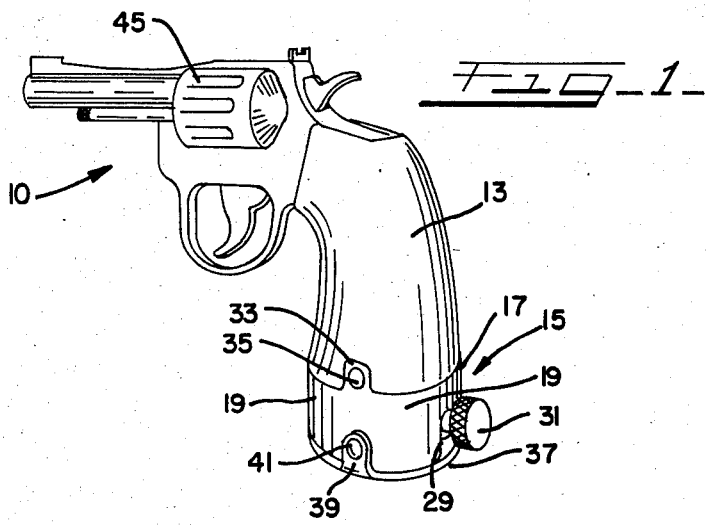
FIG. 1 is a perspective view of one embodiment of the ammunition storage compartment of the present invention shown in its fastened position.

As shown in FIG. 1, a revolver 10 is illustrated including a pistol grip 13. The pistol grip 13 is of a standard design, and is often furnished in two complementary halves which are secured together through the handle of the revolver. The pistol grip 13 may be formed of wood, plastic or any other suitable material. The grip 13 utilized with the present invention has been modified to include a pair of fasteners 14, the purpose for which will become apparent. The fasteners 14 are illustrated as being male snap members but other fasteners can be used to accomplish the same result.

Figure 2:
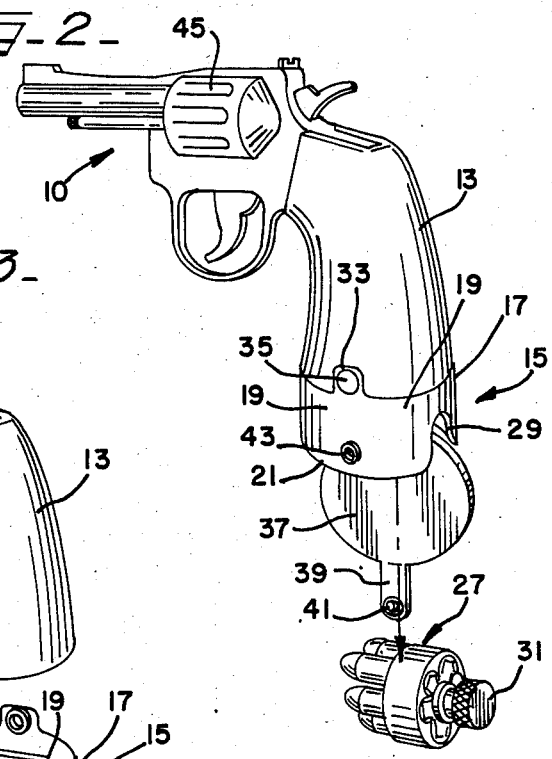
FIG. 2 is a perspective view showing the storage compartment of FIG. 1 opened and the cartridge holder disengaged from the housing.
Figure 3:
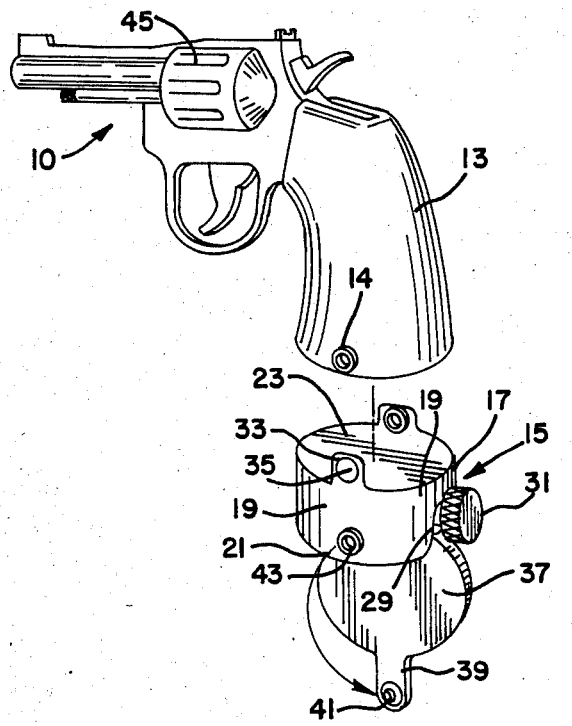
FIG. 3 is a perspective view showing the storage compartment of FIG. 1, prior to attachment to the pistol grip, with the fast loading cartridge holder in place in the housing.

The ammunition storage compartment of the present invention is shown generally as 15. The storage compartment 15 may be made of leather, plastic or any other suitable material. The compartment 15 of the preferred embodiment includes a substantially cylindrical housing 17 with a downwardly extending side wall 19 and an open bottom 21 as best illustrated in FIG. 2. As shown in FIG. 3, an upper wall 23 is provided at the top of the side wall 19 and is disposed between the butt of the pistol grip 13 and the storage compartment 15. The upper wall 23 acts to seal the housing against the entrance of contaminants from above.

The storage compartment 15 is sized to receive a fast loading plural cartridge holder 27. The size of the compartment, and consequently the size of the housing 17, will vary in order to accommodate different size pistols and holders, the size of the holders 27 depending upon the number of cartridges in the holder and the caliber of the bullets.

A recess 29 in the form of a substantially inverted U is provided in the rear face of the housing 17. The recess 29 is sized to receive the lug member 31 of the cartridge holder 27 such that when the cartridge holder is inserted into the compartment and the lug member 31 is slid up into the recess 29, the entire cartridge holder 27, save the lug member 31, is completely concealed within the housing.

The housing 17 is releasably attached to the fasteners 14 on the pistol grip 13 by means of tab extensions 33 extending upwardly from the housing 17 and provided with fasteners 35 secured therein. The fasteners 35 are illustrated as female snap members in FIG. 3 in order to coact with the corresponding male fasteners 14 in the pistol grip 13, however, other fastening means may be utilized to accomplish the same result. It is also within the scope of the present invention to locate the various fastening means on the bottom of the pistol grip and the upper wall of the housing to provide the releasable attachment between the housing and the pistol grip.

A flap 37 extends downwardly from the outside face of the housing 17. The flap 37 has a generally ellipsoidal shape and is sized to cover the open bottom 21 of the compartment 15 in the housing 17, thereby inhibiting the entrance of contaminants through the open bottom 21 of the recess 25 and securing the cartridge holder 27 therein. As shown in FIGS. 2 and 3, a tab extension 39 extends from the bottom of the flap 37. A fastener 41 is provided on the tab extension 39, the fastener 41 designed to coact with a corresponding fastener 43 provided on the inside face of housing 17. Although a snap fastener is shown in the drawings, any number of means may be employed to secure the tab extension 39 of the flap 37 to the housing 17, as, for example, a Velcro® fastener. While the flap 37, as shown in the drawings, is an integral part of the housing 17, the flap 37 may be hingedly connected to the base of the housing 17.

The embodiment of the storage compartment illustrated in the drawings is adapted for use by a right-handed person, the snap 14 being located on the left side of the grip for actuation by the thumb of a right-handed pistol holder. The storage compartment 15 may be readily adapted for use by a left-handed person by transposing the integral flap 37 and tab extension 39 with the fastener 43 so that the flap 37 may be opened from the other face of the housing 17 when the revolver 10 is used by a left-handed person.

The preferred embodiment, as illustrated in FIGS. 1, 2 and 3, utilizes a compartment with an open bottom for insertion of the cartridge holder. It is also within the purview of the present invention to utilize a housing which is closed on the top and bottom and provides an access opening for insertion of the cartridge holder through the side wall. In such an embodiment, a flap would be utilized which seals over the access opening to protect against the entry of contaminants.

The cartridge holder 27 may be stored in the housing 17 of the FIG. 1 embodiment by unfastening the tab extension 39, moving the flap 37, and inserting the cartridge holder 27 within the compartment 15 of the housing 17, such that the lug member 31 of the cartridge holder 27 is slid up into the recess 29 provided in the rear face of the housing 17. The flap 37 is then drawn over and across the open bottom 21 of the compartment and the tab extension 39 refastened, thereby securing the cartridge holder 27 within the housing 17.

When it is desired to reload the revolver 10 using the cartridge holder 27 which is stored in the housing 17, the cylinder 45 of the revolver 10 is opened to the loading position and the tab extension 39 is unfastened from the housing 17. The cartridge holder 27 is then disengaged from the compartment 15 of the housing 17 by exerting downward force on the lug member 31 of the cartridge holder 27 using one's thumb or hand. The bullets may then be simultaneously loaded into the empty cylinder chamber 45 of the revolver 10 and the empty cartridge holder 27 replaced or another loaded cartridge holder substituted in the housing 17.

The embodiment illustrated in FIGS. 1 through 3 shows a compartment in which the speed loader lug 31 is exposed. Other embodiments utilizing the principles of the present invention may incorporate a housing which is completely closed about its periphery so that the lug 31 is concealed. Certain embodiments of speed loaders incorporate a lug of substantially smaller size than illustrated in the drawings and some may have no lug at all.

Thus it has been shown that the present invention provides a detachable ammunition storage compartment especially designed to contain a fast loading plural cartridge holder which may be releasably secured to the pistol grip of a revolver.

Various features of the invention have been particularly shown and described in connection with the illustrated embodiment of the invention, however, it must be understood that these particular arrangements merely illustrate and that the invention is to be given its fullest interpretation with the terms of the appended claims.

What is claimed is:

1. A readily detachable ammunition storage compartment especially adapted to releasably contain a fast loading plural cartridge holder for revolvers including a housing defining a substantially circular chamber for storage of said cartridge holder, first fastening means associated with said housing adapted to releasably secure said housing to a pistol grip, a flap connected to said housing operative to assume either an open or a closed position, said flap defining a wall of said housing when said flap assumes said closed position, second fastening means associated with said flap adapted to secure said flap in said closed position but easily and selectively releasable by a holder of said pistol to allow said flap to open whereby the cartridge holder may be released for loading of said cartridges into said revolver.

2. An ammunition storage compartment as in claim 1 including an upper wall of said housing disposed between the butt of said pistol and said storage compartment to seal the storage compartment against the entry of contaminants from above.

3. An ammunition storage compartment as in claim 1 including a recess defined in said side wall of said housing, said recess adapted to accommodate a protrusion from said cartridge holder.

4. An ammunition storage compartment as in claim 1 including a plurality of tab extensions extending upwardly from said housing for attachment to said pistol grip, said first fastening means adapted to secure said tab extensions to said pistol grip.

5. An ammunition storage compartment as in claim 1 in which said flap is an integral portion of said housing.

6. An ammunition storage compartment as in claim 3 in which said recess is in the form of a substantially inverted U and is sized to receive a lug member of said cartridge holder allowing said lug to remain exposed when said flap is secured in said closed position so as to assist in removal of said cartridge holder when said flap is in said opened position.

* * * * *